US005291020A

United States Patent [19]

Lee

[11] Patent Number: 5,291,020

[45] Date of Patent: Mar. 1, 1994

[54] METHOD AND APPARATUS FOR DETECTING DIRECTION AND SPEED USING PIR SENSOR

[75] Inventor: Wade Lee, Alamo, Calif.

[73] Assignee: Intelectron Products Company, Hayward, Calif.

[21] Appl. No.: 817,876

[22] Filed: Jan. 7, 1992

[51] Int. Cl.[5] ..... G08B 13/191

[52] U.S. Cl. ..... 250/342; 250/338.3; 250/349

[58] Field of Search ..... 250/338.3, 342, 349

[56] References Cited

U.S. PATENT DOCUMENTS

| | | | |
|---|---|---|---|
| 4,704,533 | 11/1987 | Rose et al. | 250/342 |
| 4,799,243 | 1/1989 | Zepke | 377/6 |
| 4,914,298 | 4/1990 | Quad et al. | 250/349 |
| 4,943,800 | 7/1990 | Ikeda et al. | 340/567 |
| 4,963,749 | 10/1990 | McMaster | 250/349 |

FOREIGN PATENT DOCUMENTS

| | | | |
|---|---|---|---|
| 63-293426 | 11/1988 | Japan | 250/338.3 |
| 1-92627 | 4/1989 | Japan | 250/338.3 |
| 1-119789 | 5/1989 | Japan | 250/353 |

*Primary Examiner*—Constantine Hannaher
*Attorney, Agent, or Firm*—Elliot B. Aronson

[57] ABSTRACT

A dual pyroelectric-effect sensor having the sensing elements aligned in a motion plane permits direction determinations to be made for moving IR sources. Dual sensing-element PIR sensors provide different voltage outputs depending upon a relative direction of movement of an object and the sensing elements. By alternating the effective polarizations of the sensing elements in the PIR sensor, clear direction information is available from the PIR sensor. A direction detecting circuit working in cooperation with a switch controller employing a counter and a timer, permits independent tallying of entrances and exits. Upon the counter indicating that the number of objects that exited the area equals the number of objects that entered, the lights are immediately extinguished. The timer ensures that the lights turn off should incorrect values become recorded in the counter.

7 Claims, 5 Drawing Sheets

METHOD AND APPARATUS FOR DETECTING DIRECTION AND SPEED USING PIR SENSOR

BACKGROUND OF THE INVENTION

The present invention relates generally to pyroelectric infrared (PIR) sensors, and more specifically to PIR sensors used to detect direction and speed.

PIR sensors are well known in the art. These sensors are commonly used in security systems for measuring motion in a monitored area. PIR sensors use materials having a pyroelectric effect. One common material is $LiTaO_3$, which in its crystalline form is spontaneously polarized (i.e. electrical dipoles in the crystal structure develop). Heating the $LiTaO_3$ crystal to a temperature just below its Curie temperature in an electrical field causes these dipoles to line up in a direction of the electrical field.

Bringing opposing electrodes into contact with the polarized crystal causes the surface to be electrically charged. Ions in the air neutralize this surface charge. Thereafter, the crystal absorbs incident infrared radiation (IR). The absorption of the IR causes the temperature of the crystal to change, altering the spontaneous polarization and thus the number of dipoles. The change in the number of dipoles unbalances surface charges on the crystal's surface. It is possible to measure this surface charge imbalance as a voltage change. Thus, voltage changes on the surface of the crystal are indications of incident IR. The voltage change and the subsequent detection of IR required a temperature change in the crystal. To include a temperature change in the crystal requires either a moving IR source, or a chopper disposed between the crystal and the IR source.

FIG. 7 is a schematic presentation of the pyroelectric effect. At the top of FIG. 7 a source of IR is shown modulated by a chopper. The chopper first is closed, then opened to illuminate a pyroelectric crystal with the infrared radiation, and then subsequently closed. Below the status graph of the chopper is seen the charge distribution of the crystal surface corresponding to the chopper status. Position A, with the chopper closed prior to illumination, shows a balanced surface charge aligned with an electric field (not shown). Position B, opening the chopper, disturbs the balance of the dipoles, producing a net positive charge distribution. Position C occurs sometime later with the chopper open, after excess surface charge is neutralized and charge becomes rebalanced at the new dipole generation rate. Thereafter, at position D (closing the chopper), induces an equal but opposite charge distribution in the crystal. Ions become associated with the unbalanced crystal charge at position E, sometime later. The graph below the representations of the crystal charge distribution illustrates output from a sensor employing such a crystal.

FIG. 8 is a schematic diagram of a prior art PIR detector 100 consisting of dual pyroelectric elements ($LiTaO_3$) 102*a,b* a high-ohmic resistor 104, and a low-noise field effect transistor (FET) 106 built into a TO-5 package. The TO-5 package includes a window 110 made up of a silicon filter which limits incident rediation to wavelengths in a prespecified range.

The prior art employed dual element sensors to reduce noise signals from the sensor. FIG. 9 is a top view of a PIR sensor 100 having two sensing elements 102*a* and 102*b*. Typically, the sensing elements are one millimeter by two millimeters and separated by a one millimeter space. The polarities of the sensing elements are reversed as shown., with the sensing elements oriented at about a forty-five degree angle to improve the noise reduction feature of the sensing element.

It is common in the prior art to employ these PIR sensors in switches to control room lighting, for example. In one common application, a switch with a PIR sensor is mounted to monitor an entrance to a room. When a person enters the room, the PIR sensor detects the entrance and begins operation of a timer. Subsequent detections of persons entering or leaving the room will reset the timer. When the timer expires, the switch automatically turns the lights off. This is a desirable energy-saving feature. These switches do not have an ability to detect relative motion of the person entering or leaving the room, so that a person leaving the room will reset the timer. If the switch were able to discriminate between a person entering or leaving, the switch could immediately turn the lights off rather than waiting for the timer to expire.

SUMMARY OF THE INVENTION

The present invention provides method and apparatus for detecting direction and speed of an object moving in a field of view of a PIR sensor. The invention permits switches incorporating the invention to determine whether a person enters or leaves a room, and permits immediate extinguishing of room lights when a person leaves. Additionally, a counter permits comparison of numbers of counts of objects entering and leaving. Upon determining that a number of exits equals a number of entrances, the switch extinguishes the lights. By employing a plurality of the direction indicating sensors, a velocity of an object, both its direction and speed, should be determinable.

According to one aspect of the invention, it includes a dual element pyroelectric infrared sensor (PIR) with its sensing elements oriented in a motion plane. An electronic circuit coupled to an output of the PIR sensor measures for voltage levels of an output signal to determine a relative direction of motion for an object moving in the monitored motion plane. Use of multiple PIR sensors, having two or more sensing elements permits speed determinations of the moving object.

The present invention permits construction of even more energy conservative switches than those of the prior art without additional sensing elements. There are many potential uses for a sensing element which is able to not only to detact a moving object, but also a direction or velocity of the moving object.

Reference to the remaining portions of the specification and drawings may realize a further understanding of the nature and advantages of the present invention.

DESCRIPTION OF SPECIFIC EMBODIMENTS

Figure 1:
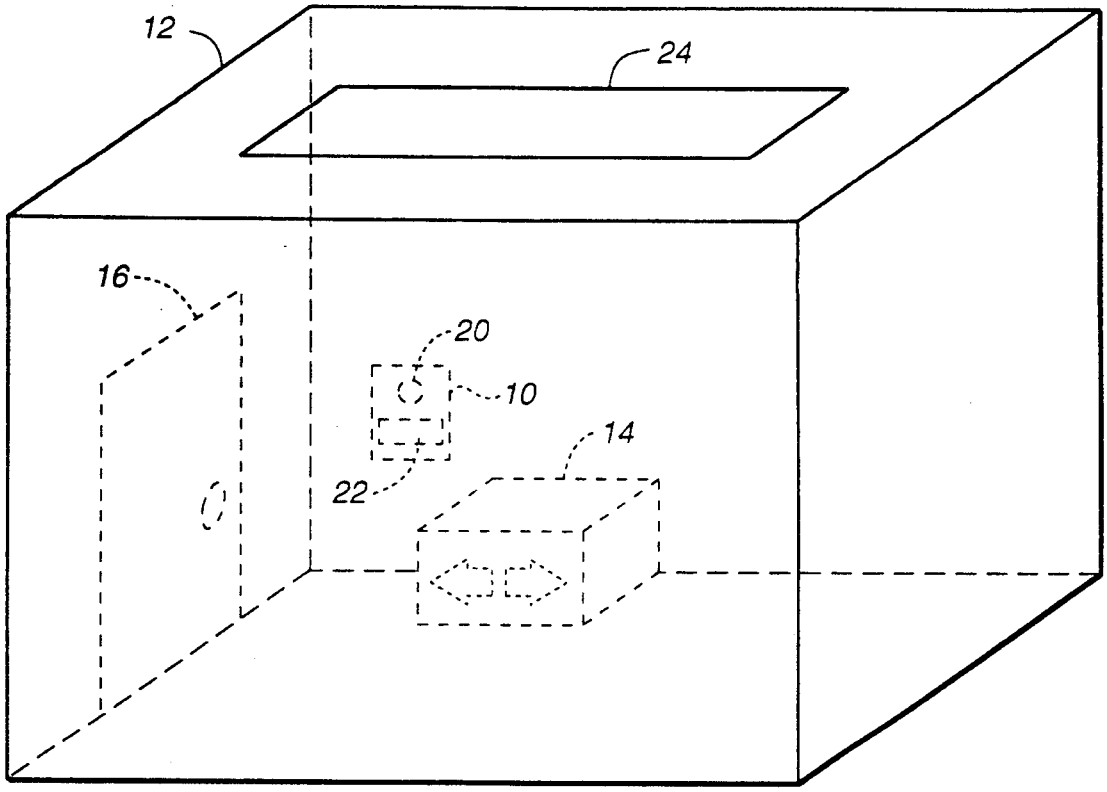
FIG. 1 is a perspective view of a wall-mounted switch 10 monitoring a room 12. An object 14 in the room 12 passes within a field of view of the switch 10 and advances either toward or away from a door 16.

FIG. 1 is a perspective view of a wall-mounted switch 10 monitoring a room 12. An object 14 in the room 12 passes within a field of view of the switch 10 and advances either toward or away from a door 16. Preferably, the switch is placed so that the field of view monitors all entrances and exits from the door 16. For purposes of this description, I define a plane of motion for the object 14 as movement in a plane extending toward and away from the door 16. The arrows on the object 14 roughly identify its plane of motion. The switch 10 includes a pyroelectric infrared (PIR) sensor 20 and a manual on/off control 22.

In operation, the object 14 initially enters the room 12 through door 16. When the object enters the field of view of the PIR sensor 20, and if the on/off control 22 is on, then the switch 10 will illuminate lights 24. Advancing the object 14 further into the room 12 and out of the field of view of the PIR sensor 20 does not cause the lights 24 to extinguish. When the object 14 is detected moving toward the door 16, and subsequently leaves the field of view of the PIR sensor 20, the lights 24 are extinguished immediately.

In the case where more than one object 14 enters or leaves the room 12, the switch 10 optionally includes a counter (not shown). The PIR sensor detecting an entrance into the room 12 of an object increments the counter. Detecting an exit of an object from the room 12 decrements the counter. After decrementing the counter, the switch 10 extinguishes the lights if the counter indicates that all the objects have exited the room 12.

In one preferred embodiment of the present invention, a timer is used to ensure that the lights 24 are extinguished properly in the event that switch 10 does not discriminate multiple objects entering or leaving, such as when two objects enter or leave together.

In another preferred embodiment of the present invention, multiple sensors and switches permit resolution of multiple object entries and exits. Additionally, for rooms having multiple entrances and exits, positioning a switch, or sensor, near each such entrance or exit properly monitors these rooms. A master counter for the room is incremented upon any entry and decremented for each exit, irrespective of which entrance or exit the object employed. Each exit checks the counter to determine if the room is empty. When the last object leaves, the lights are extinguished. For systems employing timers, each entrance into the room of an object resets the timer.

Figure 2:
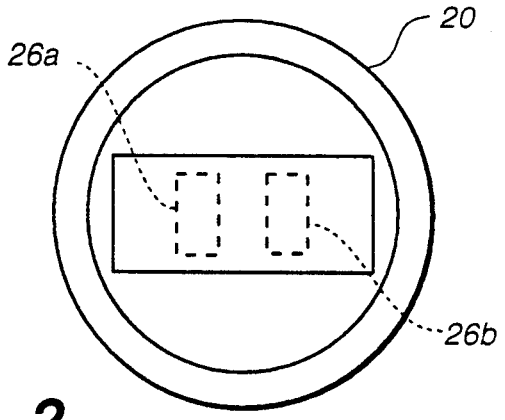
FIG. 2 is a view of the PIR sensor 20 having dual sensing elements 26*a* and 26*b;*

FIG. 2 is a view of the PIR sensor 20 having dual sensing elements 26*a* and 26*b*. As shown, for the use depicted in FIG. 1, the preferred embodiment orients the sensing elements 26*a,b* in the motion plane, which is horizontal for the application shown in FIG. 1.

Figure 3:
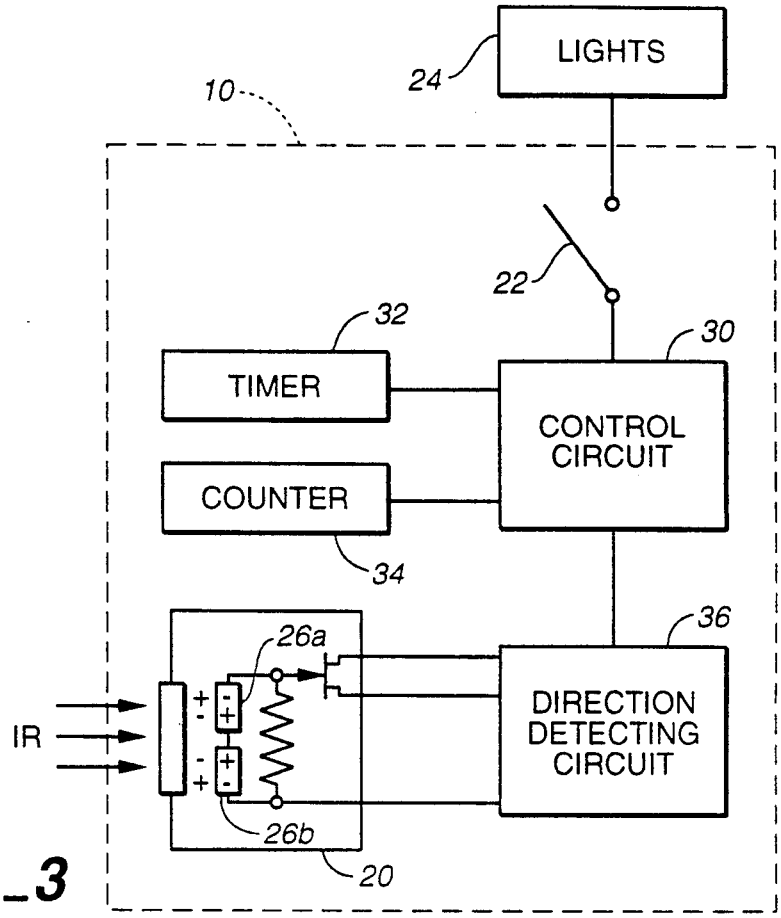
FIG. 3 is a block diagram of the switch 10 coupled to the light 24.

FIG. 3 is a block diagram of the switch 10 coupled to the lights 24. In addition to the PIR sensor 20 and the on/off control 22, the switch 10 includes a control circuit 30, a timer 32, a counter 34 and a direction detecting circuit 36. In response to movement of an object in a field of view of the PIR sensor 20, infrared radiation illuminates the dual sensing elements 26*a,b*.

Figure 4:
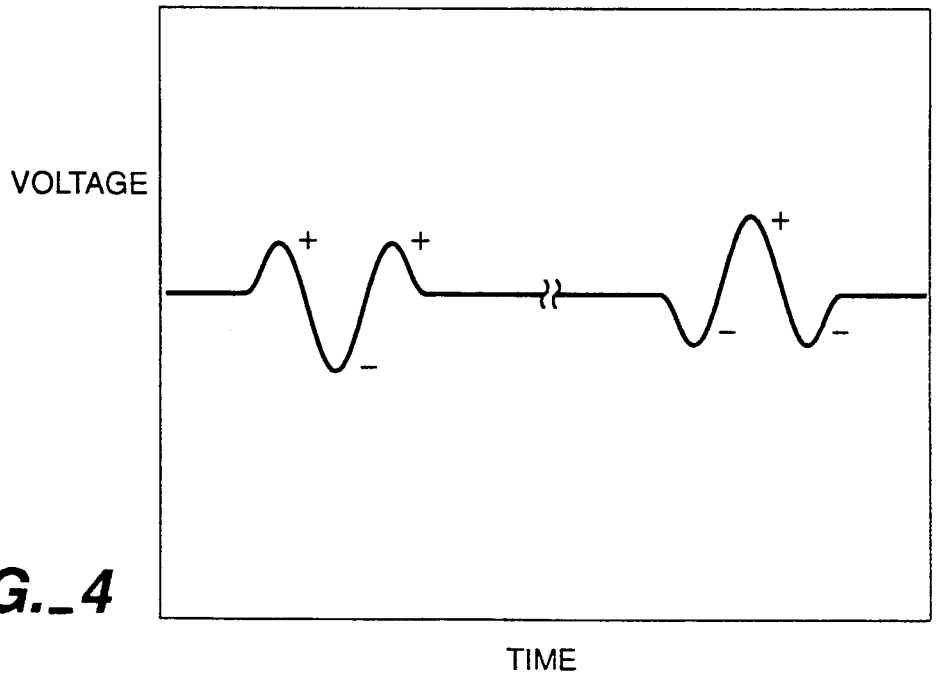
FIG. 4 illustrates a typical output from the PIR sensor 20 responsive to an IR source moving in its field of view.
Figure 7:
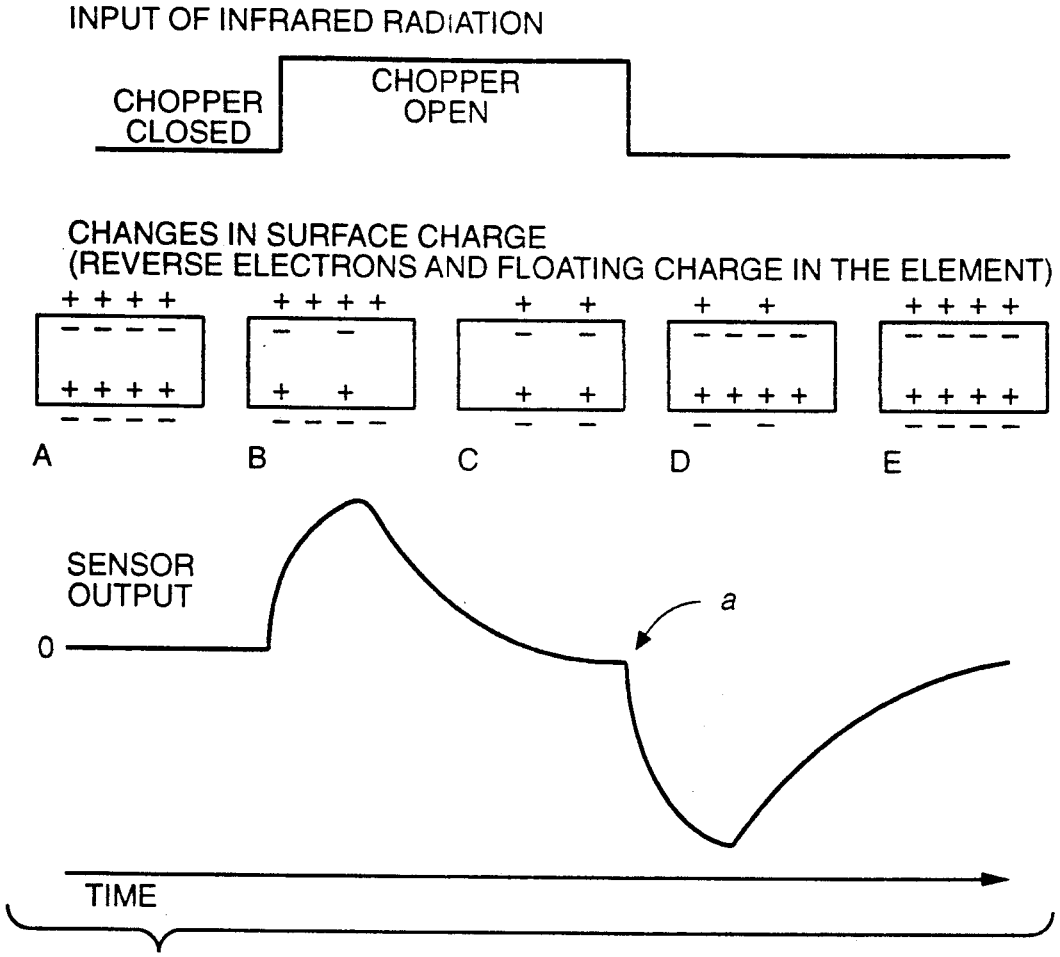
FIG. 7 (PRIOR ART)
FIG. 7 is a schematic presentation of the pyroelectric effect.
Figure 8:
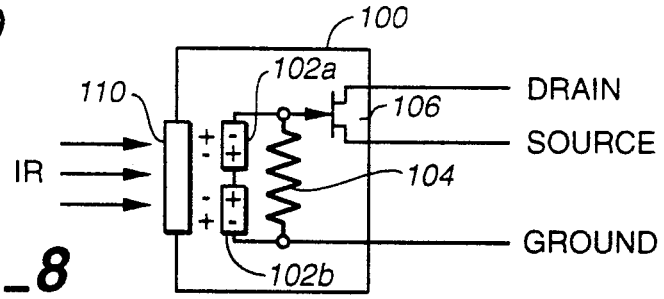
FIG. 8 (PRIOR ART)
FIG. 8 is a schematic diagram of a prior art PIR detector consisting of dual pyroelectric elements ($LiTaO_3$), a high-ohmic resistor, and a low-noise field effect transistor (FET) built into a TO-5 package.
Figure 9:
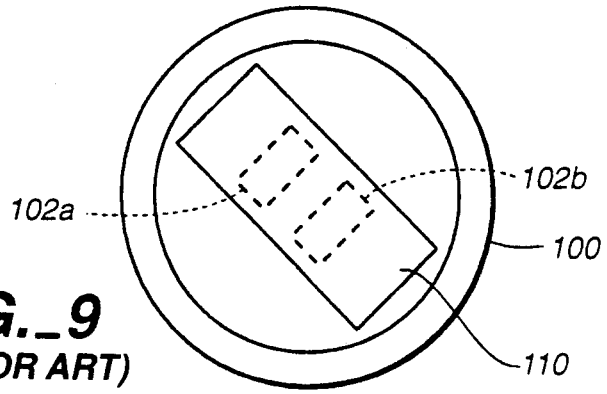
FIG. 9 (PRIOR ART)
FIG. 9 is a top view of a PIR sensor 100 having two sensing elements 102*a* and 102*b*.

FIG. 4 illustrates a typical output from the PIR sensor 20 responsive to an IR source moving in its field of view. As an IR source enters the PIR sensor's field of view, the IR illuminates one particular sensing element before the other. In the case of the configuration generating FIG. 4, the IR initially illuminates a positive sensing element first. As shown, the sensing element produces a positive voltage output, just as illustrated in FIG. 7. As the IR source continues advancing, IR no longer illuminates the positive sensing element. Without illumination, the positive sensing element produces a counter negative voltage, also as illustrated in FIG. 7. A difference between FIG. 4 and FIG. 7 is that the IR source moves on to illuminate the negative sensing element, whereas the FIG. 7 illustration includes a single sensing element. The illumination of the negative sensing element causes an initial generation of a negative voltage. The negative voltage of the negative sensing element and the counter negative voltage of the positive sensing element produces a net negative voltage having a magnitude twice that of the positive voltage. Subsequent movement of the IR source out of the field of view of the negative sensing element produces a counter voltage that is positive and that has a magnitude equal to that of the initial positive voltage.

Movement of the IR source in a direction opposite to that which produced the voltage output described above produces a different voltage output. Essentially, the voltage output is an inversion of the voltage output produced from the oppositely moving IR source. The inversion results because the IR source initially illuminates the negative sensing element, producing a negative voltage followed by its positive counter voltage as the IR source continues movement. The subsequent illumination of the positive sensing element produces a positive voltage adding to the voltage output, causing a positive voltage twice in magnitude to the negative voltage. Subsequent movement of the IR source out of the field of view of the positive sensing element produces the counter negative voltage.

The direction detecting circuit 36 of FIG. 3 monitors the output of the PIR sensor 20 to determine which of the waveforms types illustrated in FIG. 4 is present. The direction detecting circuit passes this information on to the control circuit 30. Depending upon the specific embodiment and configuration of the switch 10 and the sensing elements 26*a,b* the control circuit 30 increments or decrements the counter 34, depending upon whether the direction indicated is into the room, or out of the room.

If into the room, the control circuit 30 initiates illumination of the lights 24 if they were out, resets the time 32, and increments the counter 34. If the direction detection circuit 36 indicates that the IR source exited the room, the control circuit decrements the counter 34 and determines if a value stored in the counter 34 equals a predetermined value (typically 0). If this value is stored in the counter 34, the control circuit 30 extinguishes the lights 24. If prior to the decrementing of the counter 34 to the predetermined value, the timer 32 expires, the control circuit 30 extinguishes the lights 24.

Figure 5:
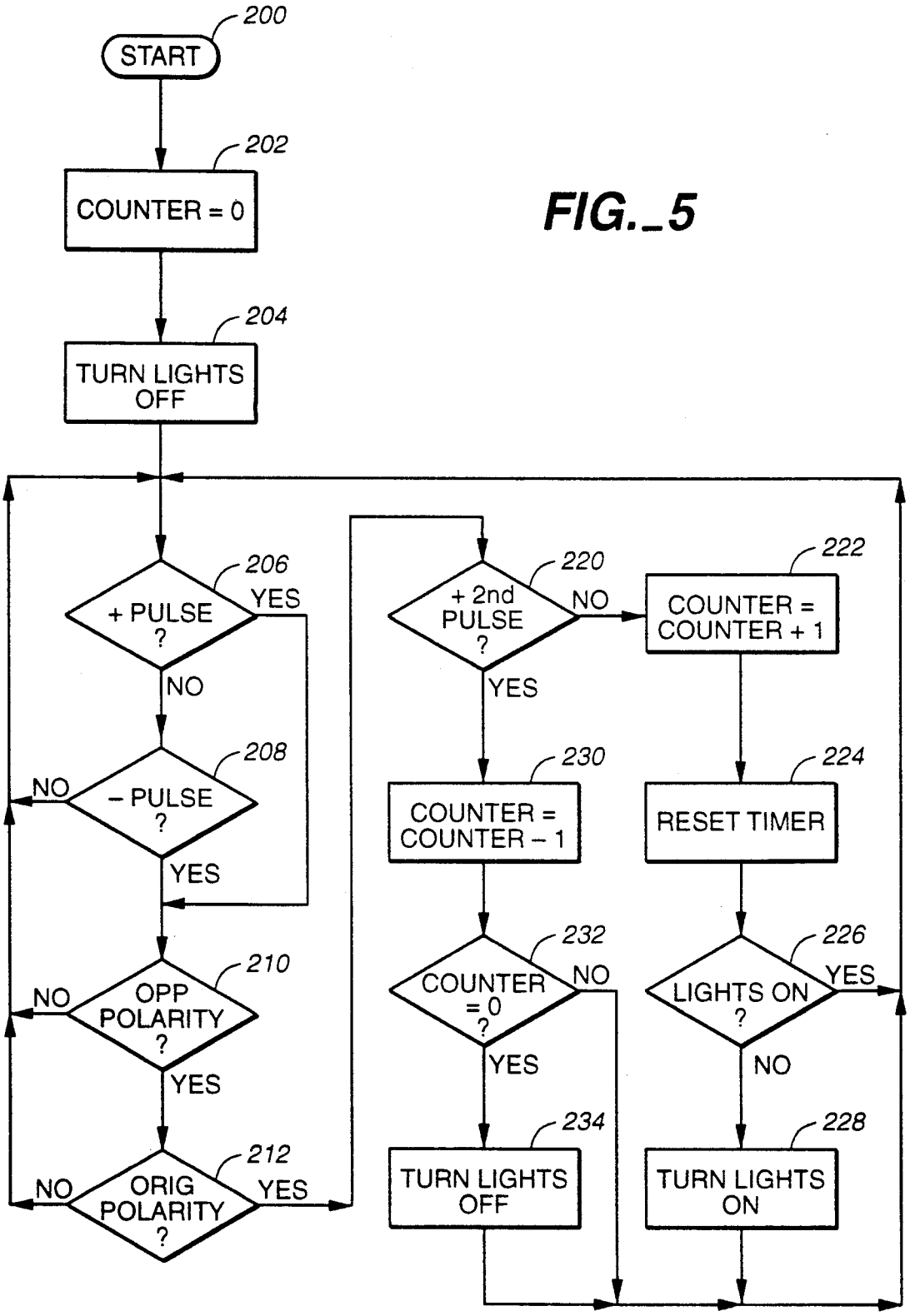
FIG. 5 is a flow chart of operation of the switch 10 diagrammed in FIG. 3.

FIG. 5 is a flow chart of operation of the switch 10 diagramed in FIG. 3. Initially, the method begins at Start, step 200. The control circuit 30 initializes the counter to zero (step 202) and turns the lights 24 of FIG. 1 off (step 204). The switch 10 waits for a pulse from the PIR sensor 20. Step 206 determines if the pulse is a positive pulse exceeding a predetermined threshold. If it not such a pulse, the system determines at step 208 whether the pulse is a negative pulse having a magnitude exceeding a predetermined threshold. If the pulse is neither a positive pulse or negative pulse of sufficient magnitude, the system branches back to step 206 to check the next pulse. If the pulse is either a positive pulse or a negative pulse of sufficient magnitude, the system next checks for a pulse of opposite polarity at step 210. This opposite polarity pulse must also exceed a predetermined threshold, which in the preferred embodiment is greater than the first pulse threshold. Failure of the second pulse to be of the proper polarity or insufficient magnitude branches the system back to step 206. If the order of the first two amplitude-qualified pulses is correct, the system checks, at step 212, for a third amplitude-sufficient pulse having a polarity like the original (first) pulse. If the pulse order for the three pulses is not correct, the system returns to step 206. Correct three pulse order advance the system to step 220. Step 220 checks whether the polarity of the second pulse of the three pulses was positive. For the signal of FIG. 4, a positive second pulse indicates that the IR source monitored exited the area being monitored. Thus, if the second pulse were not positive, the system advances to step 222 to increment the counter. Incrementing the counter indicates that a person entered the room. Upon entering the room, the system also resets the timer at step 224 and checks at step 226 whether the lights are on. If the lights are on, the system returns to step 206 to wait. If the lights are out, the system, at step 228, turns the lights on and returns to step 206.

At step 220, if there had been a positive second pulse, the counter is decremented at step 230. Checking the counter at step 232 determines if the room is now empty. If the counter is not zero, there is at least one person in the room so the lights should not be turned off. If at step 232 the counter is not equal to zero, the system branches back to step 206. However, if the counter value is equal to zero, the lights are turned off (step 234) and then the system returns to step 206.

Expiry of the timer causes an immediate extinguishing of the lights and a reset of the counter. Essentially, the system returns to start. It is possible to implement the timer in the hardware or to include timer checking in the flowchart of FIG. 5. FIG. 5 does not include timer checking. It could be accomplished by adding a timer check process into the pulse checking loop of steps 206 through 212 or after the counter check, step 232.

There is also an optional set of steps (not shown) after any of the steps 206, 208, 210 have indicated presence of a pulse. This optional step would change the switch 10 into a 'timer' mode in which the step 234 is deactivated. This could be desirable for situations in which the counter recorded an incorrect number of objects. The switch is the timer mode would still monitor direction and perform different actions based upon whether an object entered or left. Entering the room causes the timer to be reset and lights to be turned on. Leaving the room has no effect on the timer, and it continues to count down to a point where it will turn the lights off after a sufficient time lapse from the last detected entrance.

Figure 6:
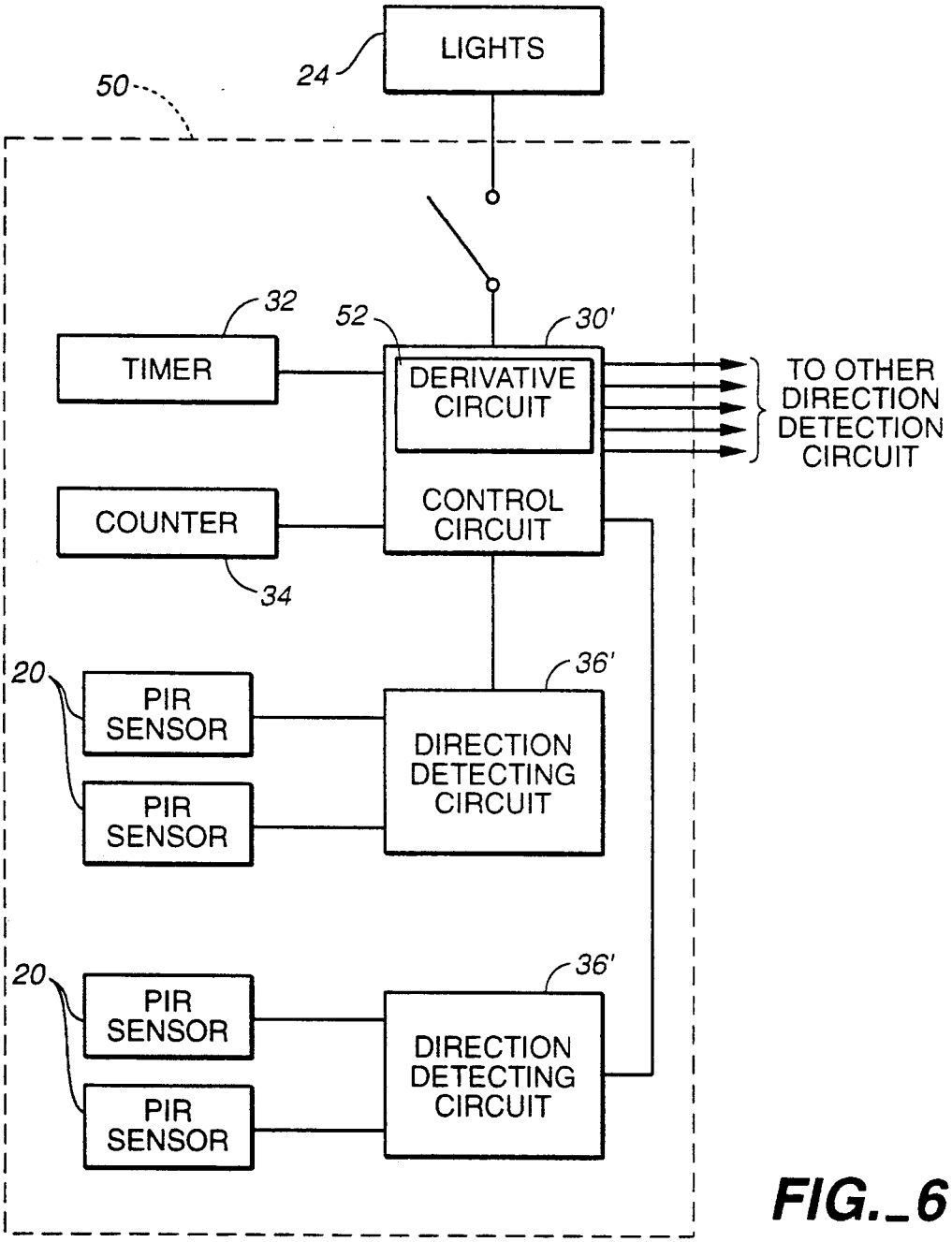
FIG. 6 illustrates a multiple PIR sensor 20 detector 50.

FIG. 6 illustrates a detector so with multiple PIR sensor 20. The control circuit 30' monitors each of a plurality of direction detecting circuits 36' corresponding to a plurality of PIR sensor 20. For multiple entrances into a room, the detector 50, configured so that a PIR sensor 20 monitors each entrance, will efficiently control the lights of the room. The operation of the detector 50 is similar to that of the switch 10 except that the control circuit 30' receives a plurality of signals indicating entries and exits of IR sources. For each entry, the control circuit 30' increments the counter 34, while it decrements the counter 34 for exits. The timer, reset at each entrance, will cause the control circuit 30' to extinguish the lights if it expires prior to the counter 34 attaining a predetermined value.

The configuration of FIG. 6 is useful for more than multiple entrance rooms. By proper positioning of the PIR sensors 20 and their associated direction detection circuits 36' and including a derivative circuit 52 within the control circuit 30', velocities of the moving IR sources is determinable. Velocity is a derivative of position with respect to changes in time. Thus, when a moving IR source passes by two PIR sensors 20, the control circuit 30' can determine elapsed time between detections of the moving IR source by the different PIR sensors 20 and determine a speed of the moving IR source. By understanding the physical relationship between the PIR sensors 20 and their relative positioning, various information relating to the IR source's motion are determinable. In fact, the shape of each of the waveforms of FIG. 4 encode speed information as well, which is usable by the system depending upon particular applications.

In conclusion, the present invention offers a simple and cost effective mechanism to measure direction and speed of an object in addition to motion detection by use of PIR sensors. While the above is a complete description of the preferred embodiments of the invention, various alternatives, modifications, and equivalents are possible. For example, thin film sensing elements, or other materials exhibiting the pyroelectric effect, are substitutable for the $LiTaO_3$ sensing elements. Additionally, different ways of discriminating the voltage signals to produce the motion information, such as determining direction by detecting a large voltage, plus or minus indicating direction, or using the voltage transitions. For example, two positive and one negative pulse identifies a particular direction. Additionally, checking a polarity of a 'sandwiched' pulse will also indicate direction. Other variations include addition of more sensors or more sensing elements, or both. Speed and distance information is available from knowledge of the optics and sensor/sensor elements spacings. An additional sensor/sensor elements, for some embodiments, improves object counting, permitting confirmation of object counts. Addition of an audio sensor to reset the timer helps to prevent prematurely extinguishing the lights. In the description, the preferred embodiments presume a stationary sensor and moving IR sources. It is one variation to mount the sensors on rotating structures or to employ mechanical choppers. Furthermore, the described embodiment includes reversed polarity sensing elements. Another embodiment of the present invention includes two or more similarly polarized elements arranged so that the detection signals of each are individually detected. A barrier between two similarly polarized elements would enhance detection performance. By separately detecting each of the signals from each of at least two of the similarly polarized detecting elements, a direction and speed of an object's motion is detectable. Therefore, the above description does not limit the scope of the invention that is defined by the appended claims.

What is claimed is:

1. A motion detecting apparatus comprising:

a PIR sensor having at least two sensing elements contained within a housing having an aperture providing a field of view including said sensing elements, said at least two sensing elements each having a polarization and being electrically coupled with their polarizations in opposition to one another; and said at least two sensing elements being disposed and arranged to provide a composite signal having a positive primary peak in response to a source of IR radiation moving in a first direction in said field of view and having a negative primary peak in response to the source of IR radiation moving in an opposite direction to said first direction in said field of view; and direction determining means, coupled to said electrically coupled sensing elements and responsive to said composite signal, for determining the direction of movement of the source.

2. The motion detecting apparatus of claim 1 further comprising counting means, coupled to said direction determining means, for counting the number of IR sources moving in said first direction.

3. The motion detecting apparatus of claim 2 wherein said counting means further counts the number of IR sources moving in said opposite direction.

4. The motion detecting apparatus of claim 3 further comprising means, coupled to said counting means, for asserting a signal when the number of IR sources moving in said first direction equals the number of IR sources moving in said opposite direction.

5. A method of detecting motion, comprising the steps of:

orienting a pair of opposed-polarization sensing elements of a PIR sensor in a motion plane;

arranging said opposed-polarization sensing elements to provide a composite signal having a positive primary peak in response to a source of IR radiation moving across said sensing elements in a first direction in said motion plane and having a negative primary peak in response to the source of IR radiation moving across said sensing elements in an opposite direction to said first direction in said motion plane; and discriminating the polarity of the primary peak of said composite signal to determine the direction of motion of an IR source moving in said motion plane.

6. The motion detecting method of claim 5 further comprising the steps of:

increasing a count whenever an IR source moves in said motion plane in said first direction;

decreasing said count whenever an IR source moves in said motion plane in said opposite direction; and asserting a signal when said count reaches a predetermined value.

7. Apparatus for determining the velocity of a moving source of IR radiation comprising:

first and second PIR sensors, each PIR sensor including first and second sensing elements, each said sensing element having a polarization and the sensing elements of each PIR sensor being electrically coupled with their polarizations in opposition to one another and being disposed and arranged to provide a composite signal having a positive primary peak in response to a source of IR radiation moving in a first direction and having a negative primary peak in response to the source of IR radiation moving in an opposite direction to said first direction;

direction determining means, coupled to each said PIR sensor and responsive to said composite signal from each said PIR sensor, for determining the direction of movement of an IR source across each said PIR sensor; and means, coupled to said direction determining means, for generating a signal proportional to the average speed of the IR source as it transits said first and second PIR sensors.

* * * * *